US008661751B1

(12) United States Patent
Lawrie et al.

(10) Patent No.: US 8,661,751 B1
(45) **Date of Patent: *Mar. 4, 2014**

(54) ALIGNMENT SPACER FOR SIDING OUTSIDE CORNER

(76) Inventors: James Robert Lawrie, Spencer, WI (US); Jeanne E. Lawrie, Spencer, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/066,089

(22) Filed: Apr. 6, 2011

(51) Int. Cl.
*E04B 2/42* (2006.01)
*E04B 2/00* (2006.01)
*E04B 1/38* (2006.01)

(52) U.S. Cl.
USPC ..... 52/288.1; 52/272; 52/279; 52/287.1

(58) Field of Classification Search
USPC ..... 52/287.1, 288.1, 279, 58, 254, 255, 52/280, 282.1, 282.3, 282.4, 312, 459, 52/463, 465, 466, 469, 470, 631, 716.1, 52/718.01, 767, 272, 506.06; D25/55, D25/119, 121, 139, 164; 403/205, 217, 262, 403/295, 382, 403
See application file for complete search history.

(56) References Cited

U.S. PATENT DOCUMENTS

| | | | | | |
|---|---|---|---|---|---|
| 434,229 | A | * | 8/1890 | Arnold | 403/217 |
| 855,195 | A | * | 5/1907 | Marr | 52/463 |
| 1,129,658 | A | * | 2/1915 | Foy | 249/188 |
| 2,066,268 | A | * | 12/1936 | Hohner | 52/275 |
| 2,373,789 | A | * | 4/1945 | Smith | 52/282.3 |
| 3,338,012 | A | * | 8/1967 | Kappenhagen et al. | 312/223.1 |
| 3,525,188 | A | * | 8/1970 | Torbett | 52/288.1 |
| D221,530 | S | * | 8/1971 | Kimmel | D25/121 |
| 3,651,610 | A | * | 3/1972 | Donahue | 52/278 |
| 3,712,003 | A | * | 1/1973 | Hallock et al. | 52/254 |
| 3,717,968 | A | * | 2/1973 | Olsen et al. | 52/288.1 |
| 3,728,834 | A | * | 4/1973 | Dean | 52/282.3 |
| 3,742,668 | A | * | 7/1973 | Oliver | 52/288.1 |
| 4,071,301 | A | * | 1/1978 | Pritchard | 403/231 |
| 4,102,587 | A | * | 7/1978 | Herb et al. | 403/205 |
| 4,104,839 | A | * | 8/1978 | Balzer et al. | 52/288.1 |
| 4,127,974 | A | * | 12/1978 | Wendt | 52/287.1 |
| 4,129,971 | A | * | 12/1978 | Reusser | 52/288.1 |
| 4,161,853 | A | * | 7/1979 | Weiss et al. | 52/288.1 |
| 4,189,885 | A | * | 2/1980 | Fritz | 52/287.1 |
| 4,192,113 | A | * | 3/1980 | Martin, Jr. | 52/282.5 |
| 4,204,376 | A | * | 5/1980 | Calvert | 52/309.1 |
| 4,258,519 | A | * | 3/1981 | Hugens | 52/282.1 |
| 4,319,439 | A | * | 3/1982 | Gussow | 52/288.1 |
| D270,375 | S | * | 8/1983 | Cavalie | D25/121 |
| D271,055 | S | * | 10/1983 | Cascone et al. | D25/119 |
| 4,430,833 | A | * | 2/1984 | Balzer et al. | 52/255 |

(Continued)

FOREIGN PATENT DOCUMENTS

| | | | | |
|---|---|---|---|---|
| FR | 2803901 | A1 | * | 7/2001 |
| JP | 2001323586 | A | * | 11/2001 |
| WO | WO 2005052271 | A1 | * | 6/2005 |

*Primary Examiner* — Basil Katcheves
*Assistant Examiner* — Rodney Mintz
(74) *Attorney, Agent, or Firm* — Derek L. Prestin

(57) ABSTRACT

A prefabricated alignment spacer is provided for use as a spacer and to aid with the installation of a siding outside corner. The alignment spacer comprises a body with at least two inner walls and at least two end walls, wherein each of the end walls define an aperture for receiving a fastener to attach the alignment spacer to the outside corner of the building. The alignment spacer is preferably formed to have an angle the corresponds with the angle of the outside corner.

7 Claims, 2 Drawing Sheets

(56) References Cited

U.S. PATENT DOCUMENTS

| | | | | | |
|---|---|---|---|---|---|
| 4,569,171 | A | * | 2/1986 | Kuhr et al. | 52/242 |
| 4,642,957 | A | * | 2/1987 | Edwards | 52/242 |
| 4,706,426 | A | * | 11/1987 | Rumsey | 52/232 |
| 4,731,973 | A | * | 3/1988 | Stenemann | 52/767 |
| 4,903,449 | A | * | 2/1990 | Ellingson, Jr. | 52/288.1 |
| 4,999,961 | A | * | 3/1991 | McNary | 52/287.1 |
| 5,138,810 | A | * | 8/1992 | Kartler | 52/254 |
| 5,233,804 | A | * | 8/1993 | Miller | 52/288.1 |
| 5,347,784 | A | * | 9/1994 | Crick et al. | 52/520 |
| 5,363,617 | A | * | 11/1994 | Miller | 52/288.1 |
| 5,516,225 | A | * | 5/1996 | Kvols | 403/170 |
| 5,517,794 | A | * | 5/1996 | Wagner | 52/276 |
| 5,542,222 | A | * | 8/1996 | Wilson et al. | 52/287.1 |
| 5,664,376 | A | * | 9/1997 | Wilson et al. | 52/287.1 |
| 5,771,646 | A | * | 6/1998 | DeSouza | 52/263 |
| 5,836,123 | A | * | 11/1998 | Gulino | 52/288.1 |
| D404,834 | S | * | 1/1999 | Iliadis | D25/55 |
| 5,927,031 | A | * | 7/1999 | Martin | 52/288.1 |
| 5,960,598 | A | * | 10/1999 | Tamlyn | 52/254 |
| 5,974,748 | A | * | 11/1999 | Sciuga et al. | 52/287.1 |
| 6,041,555 | A | * | 3/2000 | Alpi | 52/11 |
| 6,219,980 | B1 | * | 4/2001 | Peck, Jr. | 52/288.1 |
| 6,263,630 | B1 | * | 7/2001 | Bennett | 52/312 |
| 6,311,442 | B1 | * | 11/2001 | Watanabe | 52/282.3 |
| 6,354,049 | B1 | * | 3/2002 | Bennett | 52/287.1 |
| D457,658 | S | * | 5/2002 | Harel | D25/121 |
| 6,553,732 | B2 | * | 4/2003 | Shaw | 52/287.1 |
| 6,625,950 | B1 | * | 9/2003 | Shreiner et al. | 52/718.01 |
| 6,631,600 | B2 | * | 10/2003 | Schiedegger et al. | 52/658 |
| 6,883,282 | B1 | * | 4/2005 | Newhart, III | 52/287.1 |
| D518,186 | S | * | 3/2006 | Zarb | D25/119 |
| 7,228,665 | B2 | * | 6/2007 | Perry | 52/287.1 |
| D560,822 | S | * | 1/2008 | Flechsig | D25/121 |
| D574,969 | S | * | 8/2008 | Taylor et al. | D25/121 |
| 7,600,355 | B1 | * | 10/2009 | Klein | 52/656.9 |
| D614,779 | S | * | 4/2010 | Ito | D25/121 |
| 7,877,943 | B2 | * | 2/2011 | Hikai | 52/288.1 |
| D649,268 | S | * | 11/2011 | Wink | D25/164 |
| 8,061,105 | B2 | * | 11/2011 | Haga | 52/631 |
| 8,136,316 | B2 | * | 3/2012 | Schwarz et al. | 52/288.1 |
| 8,371,081 | B2 | * | 2/2013 | Bennett et al. | 52/287.1 |
| 8,434,285 | B2 | * | 5/2013 | Harrison | 52/747.11 |
| 8,511,018 | B2 | * | 8/2013 | Lawrie et al. | 52/288.1 |
| 2001/0054266 | A1 | * | 12/2001 | Bennett | 52/312 |
| 2003/0037495 | A1 | * | 2/2003 | Shaw | 52/287.1 |
| 2003/0159382 | A1 | * | 8/2003 | Pinto | 52/300 |
| 2004/0074175 | A1 | * | 4/2004 | Tierney | 52/255 |
| 2004/0118076 | A1 | * | 6/2004 | Bezubic, Jr. | 52/716.1 |
| 2005/0246986 | A1 | * | 11/2005 | Dugger | 52/287.1 |
| 2005/0262784 | A1 | * | 12/2005 | Justice | 52/287.1 |
| 2006/0059830 | A1 | * | 3/2006 | Perry | 52/518 |
| 2007/0125029 | A1 | * | 6/2007 | Lawrie et al. | 52/631 |
| 2007/0151180 | A1 | * | 7/2007 | Pace et al. | 52/287.1 |
| 2009/0038247 | A1 | * | 2/2009 | Taylor et al. | 52/287.1 |
| 2010/0011690 | A1 | * | 1/2010 | Schwarz et al. | 52/314 |
| 2012/0317909 | A1 | * | 12/2012 | MacKenzie | 52/288.1 |
| 2013/0192145 | A1 | * | 8/2013 | Hoch | 52/58 |

* cited by examiner

ALIGNMENT SPACER FOR SIDING OUTSIDE CORNER

BACKGROUND OF THE INVENTION

The invention disclosed herein relates to the construction of houses and other structures and, more specifically, to the siding of houses and other buildings. The present invention provides an alignment spacer for use on an outside corner of a home or other structure in connection with the mounting of conventional vinyl, plastic, or other types of similar siding to the walls of the home or building.

During the installation of siding on the exterior walls of a home or other structure, siding outside corners are used to provide a finished edge at the outside corners. The siding from the adjoining walls of the home or building fits neatly under the siding outside corner, such that the siding outside corner provides a finished look to the corner of the home or structure.

Currently, when siding outside corners are being installed on an outside corner of a structure, an installer must hold the siding outside corner in position while it is permanently attached to the structure. Alternatively, fasteners or adhesives may be used to temporarily hold the siding outside corner in position while it is permanently attached to the structure by the installer. Additionally, prior to permanently installing the siding outside corner, the installer must ensure that the siding outside corner is straight, square, and plumb. This requires the installer to separately measure, snap chalk lines, and maintain the alignment of the siding outside corner while temporarily, and later permanently, securing it to the building. As such, the installation of siding outside corners is often a labor-intensive and time-consuming task.

BRIEF SUMMARY OF THE INVENTION

It is a feature of the present invention to provide an alignment spacer for use with exterior siding that allows the alignment spacer and siding outside corner to be easily and quickly mounted to a structure.

More specifically, the present invention provides an alignment spacer that comprises a molded plastic body. The molded plastic body forms an angle of approximately ninety (90) degrees, the usual angle of an outside corner of a structure. The body defines at least two apertures that allow the body to receive at least two standard fasteners that are used to secure the alignment spacer to the wall of the building. This allows the molded plastic body to be quickly and easily secured to the corner of the structure. As such, the present invention may be quickly and easily attached to the structure using standard fasteners.

According to a still further broad aspect of the present invention there is provided a method of securing standard siding outside corners, such as vinyl siding outside corners, to the alignment spacer without the use of fasteners or adhesives, which then holds the siding outside corner in position while it is permanently attached to the structure by the installer. The method comprises snapping the outside corners over the alignment spacer, which then holds the outside corner secure to the structure. Once the outside corners have been snapped over the alignment spacer, the outside corner may be shifted vertically into its final position and then permanently attached to the structure.

When utilizing the present invention to mount vinyl siding outside corners to a structure, the alignment spacer of the present invention is nailed to the vertical outside corners of the structure approximately three (3) feet apart before mounting the vinyl siding outside corners. The vinyl siding outside corners are then snapped into place over the alignment spacers, and the vinyl siding outside corners are then vertically aligned and permanently fastened to the structure.

The advantages of the present invention are that the alignment spacers allow for the proper straight, square, and plumb alignment of the siding outside corners, eliminating the need for separately measuring, snapping chalk lines, and maintaining the alignment of the outside corners while securing the outside corners to the structure. The alignment spacers of the present invention are easy to use, guaranty accuracy, and allow installers to save time when mounting the outside corners.

DETAILED DESCRIPTION OF THE PREFERRED EMBODIMENT(S)

Figure 1:
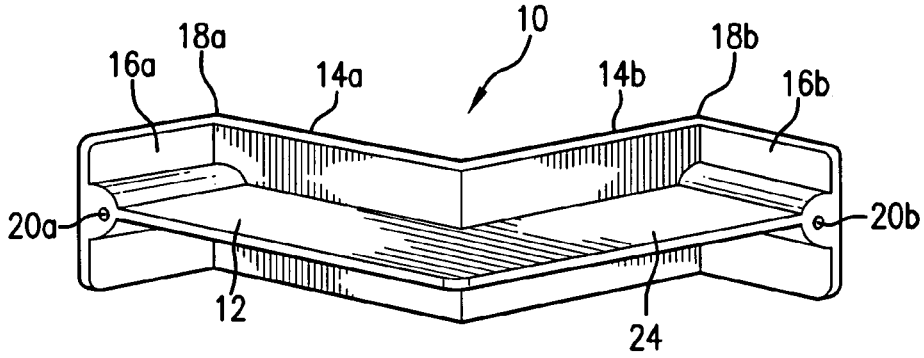
FIG. 1 is a perspective view of an alignment spacer embodying features of the present invention shown from the front side of the alignment spacer.
Figure 2:
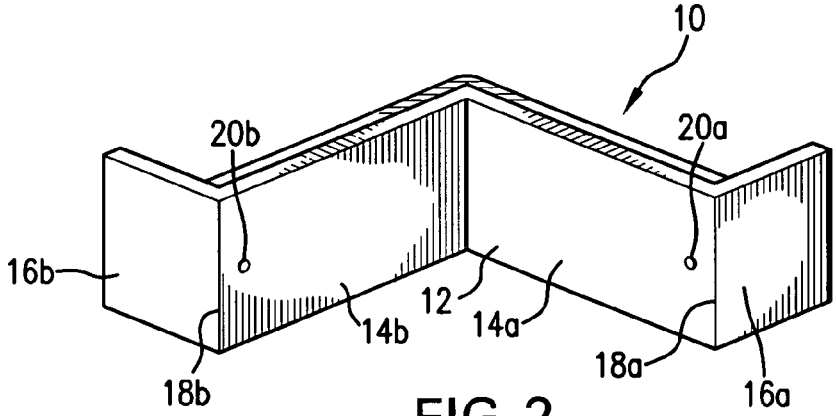
FIG. 2 is an alternative perspective view of the alignment spacer of FIG. 1 shown from the back side (wall side) of the alignment spacer.
Figure 3:
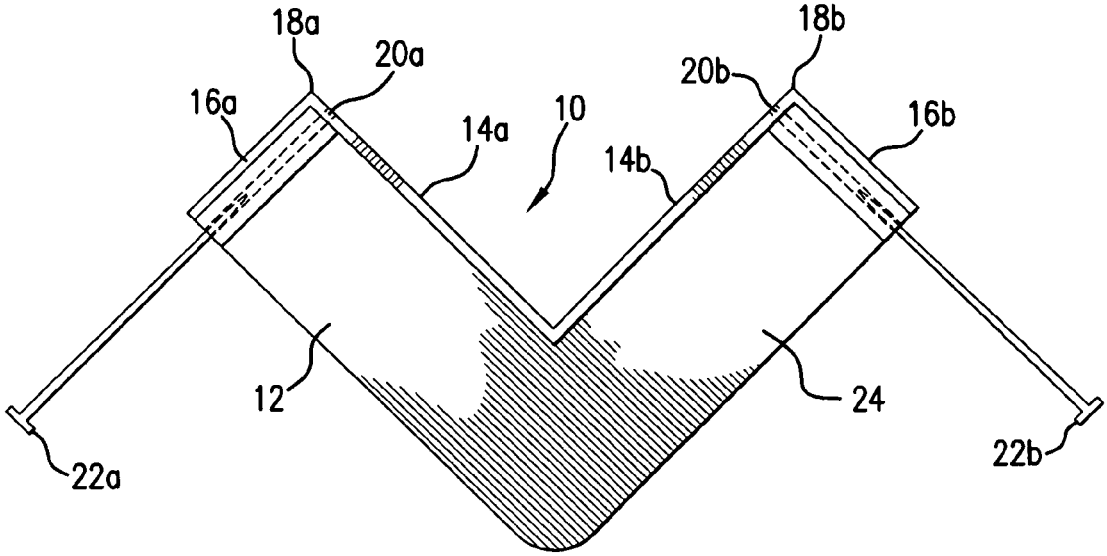
FIG. 3 is a plan view of the alignment spacer of FIG. 1.

As shown in FIGS. 1-5, the alignment spacer 10 of the present invention comprises a body 12 having an L-shaped configuration, with an angle of approximately ninety (90) degrees between the two sides of the "L", which generally matches the angle of the outside corner 100 to which it is to be attached. The body 12 of the alignment spacer 10 is preferably constructed of injection molded plastic or other similar material. However, the body 12 of the alignment spacer 10 may be constructed of any material known by one skilled in the art that is used in the production of construction supplies and implements.

The body 12 includes two inner walls 14*a*, 14*b* and two end walls 16*a*, 16*b*. The two inner walls 14*a*, 14*b* are adjacent to each other and meet at an angle that matches the angle of the outside corner 100 to which the alignment spacer 10 is to be attached. Preferably, for a standard 90-degree outside corner, the inner walls 14*a*, 14*b* meet at an angle of approximately ninety (90) degrees. The body 12 also includes a rib member 24. The rib member 24 projects from the inner surface of each of the end walls 16*a*, 16*b* runs from one end wall 16*a* to the opposite end wall 16*b*. The rib member 24 is also located adjacent to the two inner walls 14*a*, 14*b* and runs the length of the two inner walls 14*a*, 14*b*.

Each of the two end walls 16*a*, 16*b* of the body 12 are adjacent to one of the inner walls 14*a*, 14*b* of the body 12 and meet the respective inner walls 14*a*, 14*b* at an edge 18*a*, 18*b* of the body 12. The end walls 16*a*, 16*b* are configured to provide additional strength and rigidity to the alignment spacer 10, to provide a surface onto which the siding outside corner 100 may be snapped and, to provide a surface which provides sufficient friction or pressure between the siding outside corner 100 and the alignment spacer 10 to hold the siding outside corner 100 in place while it is permanently secured to the structure 104. The dimensions of the end walls 16*a*, 16*b* are selected such that mounting portions 106*a*, 106*b* of the siding outside corner 100 are held flush against both the end walls 16*a*, 16*b* and the wall 102 of the structure when the siding outside corner 100 is attached to the alignment spacer 10. The siding outside corner 100 is removably attached to the alignment spacer 10 by friction and pressure between the end walls 16*a*, 16*b* of the alignment spacer 10 and the mounting portions 106*a*, 106*b* of the siding outside corner 100.

Each of the end walls 16*a*, 16*b* also define at least one aperture 20*a*, 20*b* configured for receiving a fastener 22*a*, 22*b* for attaching the alignment spacer 10 to the wall 102 of the structure 104 to which the alignment spacer 10 is to be attached. The portion of the end walls 16*a*, 16*b* surrounding the apertures 20*a*, 20*b* preferably are slightly thicker than the portions of the end walls 16*a*, 16*b* that do not surround the apertures 20*a*, 20*b*. This thicker portion of the end walls 16*a*, 16*b* provide the end walls 16*a*, 16*b* with additional strength and rigidity and prevent the possible splitting of the end walls 16*a*, 16*b* when the apertures 20*a*, 20*b* receive the fasteners 22*a*, 22*b*, while still allowing the body 12 of the alignment spacer 10 to be constructed with a minimum of material. More specifically, these thicker portions of the end walls 16*a*, 16*b* provide the end walls 16*a*, 16*b* with additional support, such that the end walls 16*a*, 16*b* are substantially prevented from flexing. Preferably, these thicker portions of the end walls 16*a*, 16*b* are semi-circular or semi-elliptical in shape to minimize the material required to produce the alignment spacer 10, while still providing sufficient rigidity to the end walls 16*a*, 16*b* and apertures 20*a*, 20*b*. However, alternatively the thicker portions could be square or rectangular in shape, or the entire end walls 16*a*, 16*b* could have a greater thickness to provide space and support for the apertures 20*a*, 20*b*.

The apertures 20*a*, 20*b* defined by the end walls 16*a*, 16*b* are sized to allow fasteners 22*a*, 22*b*, such as a nails, screws, or other similar fasteners, to be received therein in order to secure the alignment spacer 10 to the structure 104. Preferably, the apertures 20*a*, 20*b* are sized to allow the use of a standard six-penny nails as the fasteners 22*a*, 22*b*. As such, the alignment spacer 10 of the present invention may be quickly and easily attached to the structure 104 using standard fasteners that are widely available at typical construction sites.

The dimensions for the body 12 of the alignment spacer 10 may be selected such that that the alignment spacer 10 may be used with any siding known in the art. For example, in a preferred embodiment, for standard vinyl siding outside corners, the alignment spacer 10 may have a height of approximately three-quarters (¾) of an inch, a width of approximately two (2) inches, and a thickness of approximately three-quarters (¾) of an inch. However, dimensions that allow the use of the alignment spacer 10 with different types of siding may be used without departing from the scope of the present invention.

The alignment spacer 10 of the present invention may generally be used in conjunction with the installation of vinyl siding, plastic siding or other similar forms of siding, to both residential and commercial structures. However, the alignment spacer 10 may also be used with any other siding known in the art by selecting the dimensions for the alignment spacer 10 and the body 12 that correspond with such siding.

Figure 4:
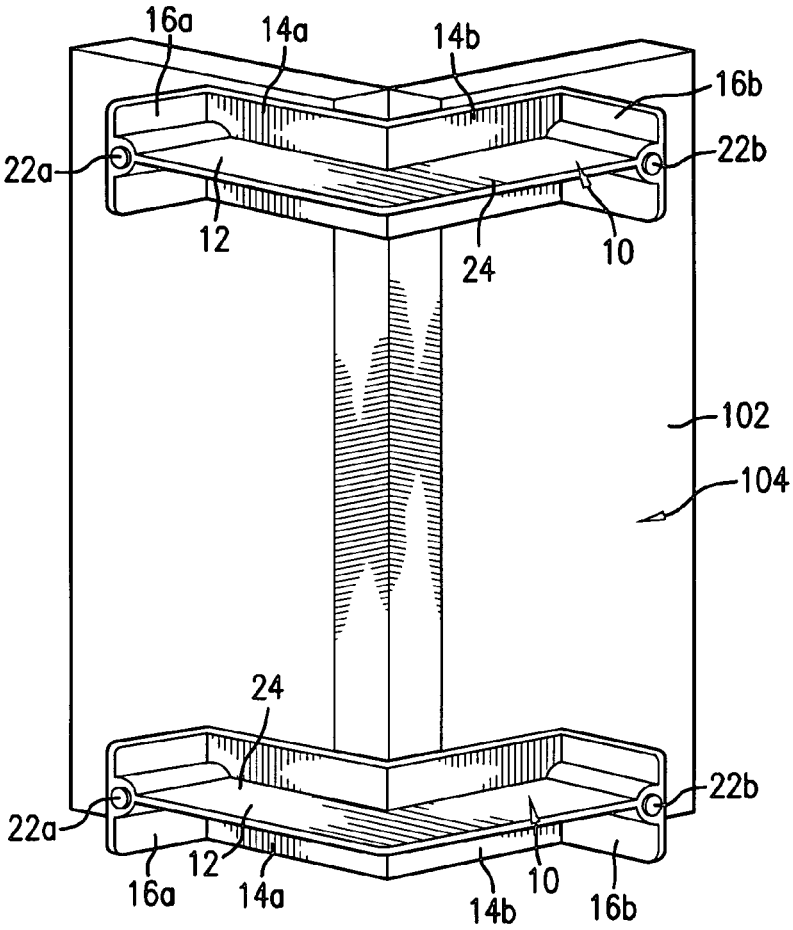
FIG. 4 is a perspective view of two of the alignment spacers of FIG. 1 attached to a corner of a structure.
Figure 5:
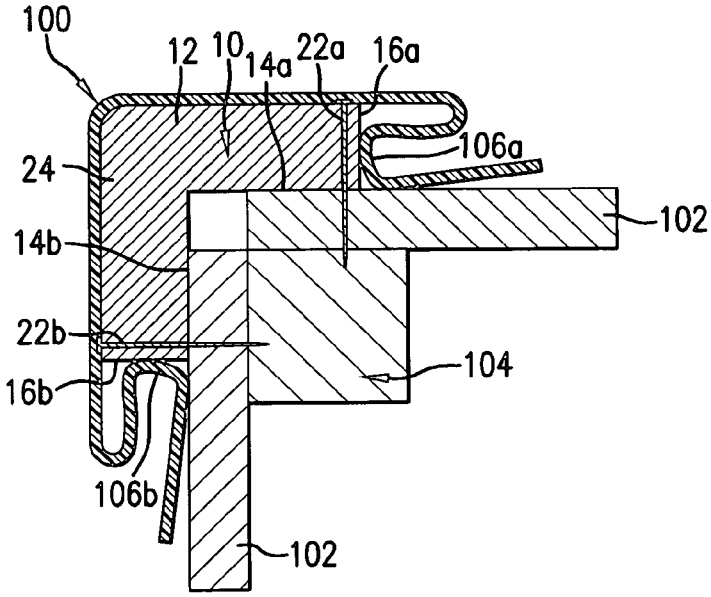
FIG. 5 is a cross-sectional view of the alignment spacer of FIG. 1 attached to a corner of a structure showing the siding outside corner secured to the alignment spacer.

As best seen in FIGS. 4 and 5, in order to use the present invention, a plurality of alignment spacers 10 are secured to the outside corner of the structure 104 approximately three (3) feet apart by driving the fasteners 22*a*, 22*b* into the wall 102 of the structure 104 before any other siding is applied to the adjacent walls 102 of the structure 104. The siding outside corner 100 may then be snapped into place over the alignment spacers 10, shifted vertically into the desired position, and secured to the structure 104 with standard siding fasteners, such as a nails, screws, or similar fasteners. Once the siding outside corner 100 has been secured to the structure 104, the remaining siding may be applied to the walls of the structure 104 in accordance with any siding installation method known in the art.

The alignment spacer 10 of the present invention may be produced by a factory in the plastic molding business, or any other similar production facility, in any way generally known in the art. The alignment spacer 10 may then be distributed through building material suppliers, siding suppliers, or other similar construction supply or retail establishments.

It will be recognized by one skilled in the art that the size, configuration, or dimensions of the alignment spacer 10 of the present invention may be adjusted to accommodate siding or siding outside corners from different manufacturers or made of different materials.

While the invention has been described in the specification and illustrated in the drawings with reference to certain preferred embodiments, it will be understood by those skilled in the art that various changes may be made and equivalents may be substituted for elements thereof without departing from the scope of the present invention as defined in the appended claims. In addition, many modifications may be made to adapt a particular situation or material to the teachings of the invention, as defined in the appended claims, without departing from the essential scope thereof. Therefore, it is intended that the present invention not be limited to the particular embodiments illustrated by the drawings and described in the specification as the best modes presently contemplated for carrying out the present invention, but that the present invention will include any embodiments falling within the description of the appended claims.

What is claimed is:

1. An alignment spacer system comprising:

a siding outside corner; and an alignment spacer, wherein the alignment spacer includes a body;

wherein the body includes a rib member, wherein the body includes at least two inner walls and at least two end walls wherein each end wall is perpendicular to one of the inner walls, wherein the rib member projects from each end wall and is located between the at least two end walls, wherein the rib member is adjacent to and spans an entire length of the at least two inner walls and between the at least two end walls, wherein the rib member and the at least two inner walls are configured to have a first angle that matches a second angle of an outside corner of a structure, wherein the outside corner of the structure is received by the first angle made by said at least two inner walls such that the inner walls abut an outer surface of the outside corner of the structure, wherein each of the at least two end walls and a portion of the rib member define at least one aperture for receiving at least one fastener for securing the alignment spacer to the structure, wherein the at least two inner walls have a height and a width and the height of the at least two inner walls is less than the width of the at least two inner walls, and wherein the siding outside corner is snapped over the body and comes into direct contact with each end wall such that the siding outside corner is engaged by the alignment spacer while allowing the siding outside corner to be shifted vertically along the outside corner of the structure.

2. The alignment spacer system of claim 1, wherein the body has an L-shaped configuration, wherein the first angle is ninety degrees, and the second angle is ninety degrees.

3. The alignment spacer system of claim 1, further comprising at least two fasteners, wherein each of the at least two fasteners are configured to be received by the at least one aperture defined by each of the at least two end walls.

4. The alignment spacer system of claim 3, wherein the at least two fasteners are nails.

5. The alignment spacer system of claim 3, wherein the at least two fasteners are standard six-penny construction nails.

6. The alignment spacer system of claim 1, wherein the body comprises a rigid plastic.

7. The alignment spacer system of claim 6, wherein the rigid plastic is an injection molded plastic.

* * * * *